US012514422B2

(12) United States Patent
Warner et al.

(10) Patent No.: US 12,514,422 B2
(45) Date of Patent: Jan. 6, 2026

(54) CLEANER HEAD

(71) Applicant: Dyson Technology Limited, Wiltshire (GB)

(72) Inventors: Andrew John Warner, Gloucestershire (GB); Andrew James Wills, Gloucester (GB); Stuart Lloyd Genn, Swindon (GB); Edward Richard Oldfield, Swindon (GB); Robert Hinchliffe, Bristol (GB); Stephen Benjamin Courtney, Gloucester (GB)

(73) Assignee: Dyson Technology Limited, Wiltshire (GB)

( * ) Notice: Subject to any disclaimer, the term of this patent is extended or adjusted under 35 U.S.C. 154(b) by 698 days.

(21) Appl. No.: 17/776,678

(22) PCT Filed: Nov. 6, 2020

(86) PCT No.: PCT/GB2020/052819
§ 371 (c)(1),
(2) Date: May 13, 2022

(87) PCT Pub. No.: WO2021/094716
PCT Pub. Date: May 20, 2021

(65) Prior Publication Data

US 2022/0395156 A1 Dec. 15, 2022

(30) Foreign Application Priority Data

Nov. 15, 2019 (GB) ..... 1916670

(51) Int. Cl.
*A47L 11/40* (2006.01)
*A47L 9/04* (2006.01)

(52) U.S. Cl.
CPC ..... *A47L 11/4041* (2013.01); *A47L 9/0411* (2013.01); *A47L 9/0477* (2013.01)

(58) Field of Classification Search
CPC ... A47L 11/4041; A47L 9/0411; A47L 9/0477
See application file for complete search history.

(56) References Cited

U.S. PATENT DOCUMENTS 6,971,140 B2 12/2005 Kim
7,059,012 B2 6/2006 Song et al.
(Continued)

FOREIGN PATENT DOCUMENTS

CN 101947095 A 1/2011
CN 204863005 U 12/2015
(Continued)

OTHER PUBLICATIONS

Office Action received for Chinese Patent Application No. 202080087039.5, mailed on Feb. 11, 2023, 14 pages (7 pages of English Translation and 7 pages of Original Document).
(Continued)

*Primary Examiner* — Marc Carlson
(74) *Attorney, Agent, or Firm* — Tucker Ellis LLP; Michael G. Craig

(57) ABSTRACT

A cleaner head including: a brushbar arrangement including a first elongate portion, and a first curved portion located at a first end of the first elongate portion. The brushbar arrangement at least partially extends around a suction region. The cleaner head further includes a drive assembly configured to rotate the first curved portion and the first elongate portion.

18 Claims, 17 Drawing Sheets

(56) References Cited

U.S. PATENT DOCUMENTS

| | | | | |
|---|---|---|---|---|
| 8,769,766 | B2 | 7/2014 | Hilton | |
| 2004/0074039 | A1* | 4/2004 | Kim | A47L 9/0444 15/319 |
| 2011/0138570 | A1 | 6/2011 | Hsu | |
| 2011/0303239 | A1* | 12/2011 | Harrison | A47L 9/0438 15/389 |
| 2016/0220084 | A1* | 8/2016 | Xu | A47L 9/0444 |
| 2018/0146773 | A1* | 5/2018 | Kress | A47L 11/4041 |
| 2019/0059676 | A1 | 2/2019 | Blum | |
| 2022/0000325 | A1* | 1/2022 | Schregardus | A47L 9/0411 |

FOREIGN PATENT DOCUMENTS

| | | | |
|---|---|---|---|
| CN | 106470585 | A | 3/2017 |
| CN | 107049141 | A | 8/2017 |
| CN | 108272394 | A | 7/2018 |
| CN | 108926290 | A | 12/2018 |
| CN | 109419459 | A | 3/2019 |
| CN | 110403530 | A | 11/2019 |
| CN | 209611011 | U | 11/2019 |
| DE | 2450484 | A1 | 5/1976 |
| DE | 2722653 | A1 | 11/1978 |
| DE | 102007007844 | A1 | 8/2008 |
| DE | 102012002894 | A1 | 8/2013 |
| DE | 102015104751 | A1 | 9/2016 |
| DE | 102015104759 | B4 | 8/2017 |
| GB | 0381331 | A | 10/1932 |
| JP | 08-289863 | A | 11/1996 |
| KR | 10-2003-0083525 | A | 10/2003 |
| KR | 10-0478790 | B1 | 3/2005 |
| KR | 20080031351 | A | 4/2008 |
| KR | 2003-0085165 | A | 11/2011 |

OTHER PUBLICATIONS

Great Britain Search Report received for GB Application No. 1916670.1, mailed on May 14, 2020, 1 pages.

International Search Report and Written Opinion received for PCT Patent Application No. PCT/GB20/052819, mailed on Feb. 18, 2021, 9 pages.

* cited by examiner

CLEANER HEAD

CROSS-REFERENCE TO PRIOR APPLICATION

This application is a § 371 National Stage Application of PCT International Application No. PCT/GB2020/052819 filed Nov. 6, 2020, which claims the priority of United Kingdom Application No. 1916670.1, filed Nov. 15, 2019, each of which are herein incorporated by reference in their entirety.

TECHNICAL FIELD

The present invention relates to a cleaner head, in particular to a cleaner head for a vacuum cleaner, for example a so called stick vacuum or robotic vacuum cleaner.

BACKGROUND

There is a constant desire to improve the pickup performance of vacuum cleaners. The cleaner head of a vacuum cleaner plays an important role in the level of debris pickup that can be achieved. For example, debris may be dirt and dust.

Cleaner heads for vacuum cleaners are often provided with brushbars, often referred to as agitators. Brushbars typically comprise bristles that are used to agitate debris from the floor surface, and are particularly important in improving the level of debris pickup from carpeted floors. Generally, a cleaner head includes a single, generally straight, brushbar housed at least partially inside a suction chamber of a cleaner head. In addition cleaner heads with two brushbars arranged parallel to each other also exist.

When a vacuum cleaner is being used, the cleaner head is moved across the surface being cleaned in forward and backward strokes whilst the brushbar rotates around a rotational axis. The brushbar can only rotate in a single direction at a time and so can only agitate and pick up dirt in a single direction, this limits how debris is agitated and limits the cleaner heads ability to clean a surface effectively. Additionally, the arrangement of existing cleaner heads makes cleaning corners (for example, corners of a room) difficult.

SUMMARY

A first aspect of the present invention provides a cleaner head comprising: a brushbar arrangement comprising a first elongate portion and a first curved portion located at a first end of the first elongate portion, wherein the brushbar arrangement at least partially extends around a suction region, and a drive assembly configured to rotate the first curved portion and the first elongate portion.

As a result, the rotation of the curved portion and the first elongate portion allows debris to be agitated in multiple directions. Therefore, the debris is more likely to be agitated from a surface and the debris is more likely to be picked up by the cleaner head. In other words, the pickup performance of the cleaner head may be improved. Additionally, debris agitated from a floor surface becomes trapped between the different portions of the brushbar arrangement. Therefore debris is more likely to be captured in the suction region and therefore picked up. The pickup performance of the cleaner head may be improved. Yet further, the combination of having an elongate portion and a curved portion allows corners (e.g. corners of a room) to be cleaned effectively and the pickup performance is improved.

The drive assembly may comprise a fixed drive connection between the first curved portion and the first elongate portion. This allows the drive assembly to easily drive the first curved portion and the first elongate portion.

The drive assembly may comprise a first motor and/or gearbox assembly located in the first elongate portion. Locating the motor in the brushbar, and specifically the first elongate portion, allows less space to be used in the cleaner head compared to, for example, a motor and a belt assembly located outside of the brushbar The first curved portion may comprise a core and one or more components may be arranged along the core. Using a core increases the stability of the curved portion and, therefore, the cleaner head is less likely to fail. As a result, the lifespan of the cleaner head can be improved.

The core may be a static core and the one or more components may be configured to rotate around the core. Keeping the core static means that the core does not need to rotate and therefore less stresses are placed on the core itself. Keeping the core static may make the core more rigid. As a result, the overall structure of the brushbar arrangement is improved.

The core may be configured to rotate and the one or more components may be configured to rotate as the core rotates. Rotating the core allows the core to be made from a more flexible material and may improve the deformability of the first curved portion and/or the second curved portion allowing corners of a room to be more easily cleaned. Rotating the core along with the one or more components may reduce the complexity of the brushbar arrangement.

A first set of bristles may be formed on the first elongate portion and a second set of bristles may be formed on the first curved portion. Including bristles on their respective brushbar portions acts to improve the agitation of debris from the surface.

The second set of bristles may be more deformable than the first set of bristles. This allows the curved portion to deform into corners of a room. Therefore, the deformable bristles allow for the cleaner head to more effectively clean the corners of a room.

The cleaner head may further comprise an energy storage device for providing energy to the drive assembly located in the first elongate portion. Locating the energy storage device in the brushbar allows valuable space to be saved on the vacuum cleaner. Further, the energy storage device can be located near the motor it drives which may improve efficiency.

The cleaner head may further comprise a second elongate portion located opposite the first elongate portion, wherein the first curved portion is located between the first end of the first elongate portion and a respective first end of the second elongate portion; and wherein the drive assembly may be further configured to rotate the second elongate portion.

As a result, the rotation of curved portion, the first elongate portion and the second elongate portion allows debris to be agitated in more directions. Therefore, the debris is more likely to be agitated from a surface and the debris is more likely to be picked up by the cleaner head. In other words, the pickup performance of the cleaner head may be improved. Additionally, debris agitated from a floor surface becomes trapped between the different portions of the brushbar arrangement. Therefore debris is more likely to be captured in the suction region and therefore picked up. The pickup performance of the cleaner head is therefore improved.

The first curved portion and the at least one of the first elongate portion and the second elongate portion may configured to rotate in a direction to direct debris toward the suction region. Advantageously, all debris that is agitated from a surface is directed toward the suction region which enables more debris to be picked up by the vacuum cleaner thus improving the pickup performance.

The cleaner head may further comprise a second curved portion located between a second end of the first elongate portion and a respective second end of the second elongate portion. In this embodiment the brushbar arrangement is in the shape of an obround. This shape allows debris to be agitated from all directions. Therefore, debris can be picked up from all directions, 360 degrees around the brushbar arrangement. Thus, pick up performance for the cleaner head is improved.

The brushbar arrangement may completely surround the suction region. Advantageously, loose debris that has been agitated from the surface is swept towards and becomes trapped in the suction region on all sides by the brushbar arrangement and therefore the debris is more likely to be successfully picked up from the surface being cleaned. Therefore, the pickup performance may be improved.

The second curved portion, the first elongate portion and the second elongate portion may be configured to rotate (along with the first curved portion) in an inward direction so as to direct debris toward the suction region. This forces agitated debris into the suction region thereby improving the pickup performance of the cleaner head.

The drive assembly may comprise a belt and/or gearbox assembly for driving the second elongate portion. This may reduce the complexity of the brushbar and may provide manufacturing benefits.

The drive assembly may comprise a second motor located in the second elongate portion. In such an embodiment a bearing arrangement can be provided between the first curved portion and the second elongate portion, and between the second curved portion and the first curved portion. Using a first and a second motor instead of a single motor to rotate and drive the brushbar arrangement allows more control over which portions of the brushbar are rotated. Further, it allows the speeds of different brushbar portions to be controlled. The size of each individual motor may also be reduced.

The first elongate portion, the second elongate portion, the first curved portion and the second curved portion may be arranged to form an obround. The obround shape allows dirt to be agitated in all directions, 360 degrees, around the suction region. The obround shape may also be able to clean corners and channels effectively.

A second aspect of the invention provides a vacuum cleaner comprising the cleaner head as described above. As a result, due to the benefits relating to the cleaner head described above, a vacuum cleaner can be achieved that performs more efficiently, and achieves improved pick up performance.

A third aspect of the invention provides a robotic vacuum cleaner comprising the cleaner head as described above. As a result, due to the benefits relating to the cleaner head described above, a robotic vacuum cleaner can be achieved that performs more efficiently, and achieves improved pick up performance.

The vacuum cleaner may be any known type of vacuum cleaner, for example a cylinder, upright, handheld, stick or robotic vacuum cleaner.

BRIEF DESCRIPTION OF FIGURES

In order that the present invention may be more readily understood, embodiments of the invention will now be described, by way of example, with reference to the following accompanying drawings, in which.

DETAILED DESCRIPTION

Directional terminology such as "front", "rear", "left and "right" are used herein with respect to the forward and rearward stroke directions of the cleaner head during typical use. Similarly, "downward" means in a direction towards a floor surface on which the cleaner head is positioned during a typical cleaning operation.

Figure 1:
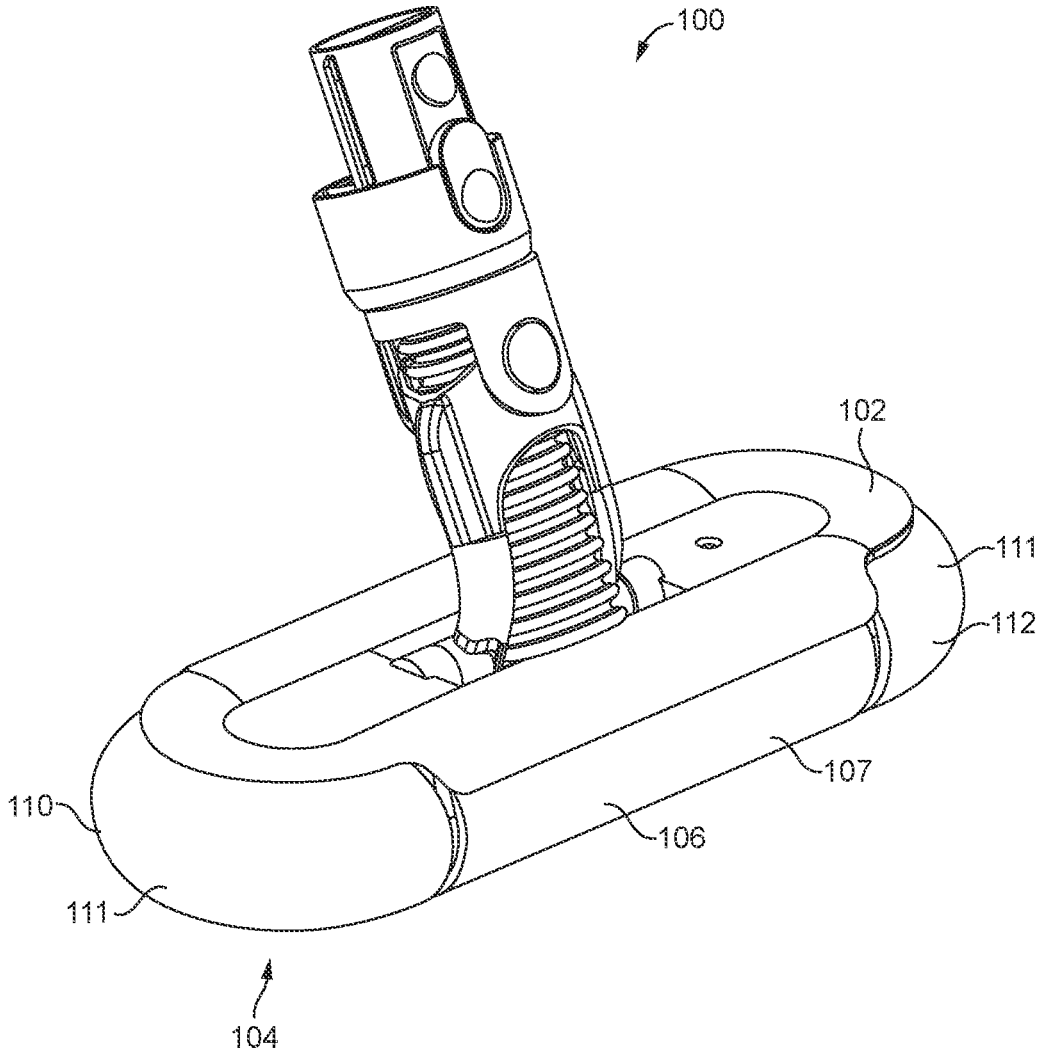
FIG. 1 shows a front perspective view of a cleaner head.
Figure 2:
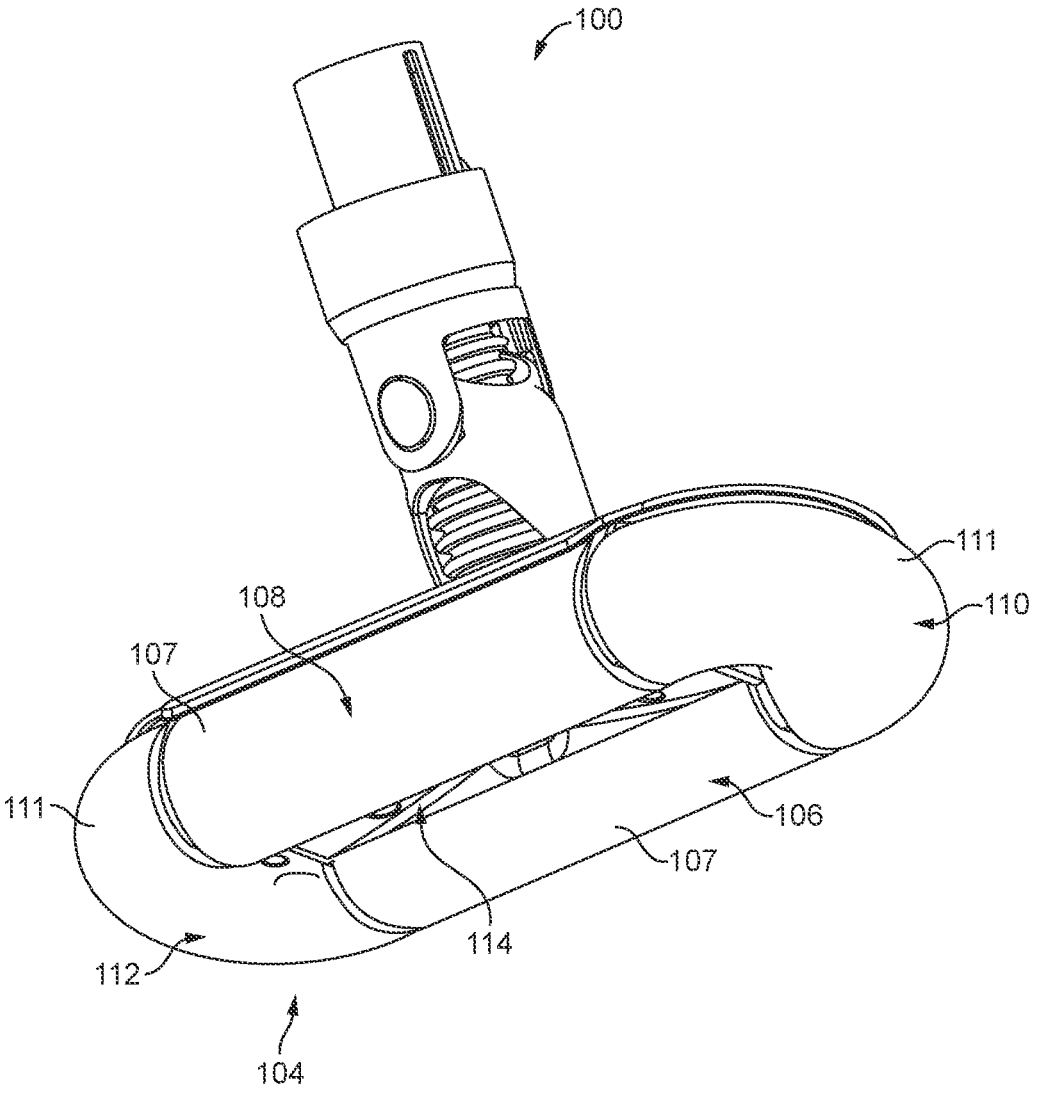
FIG. 2 shows a rear perspective view from underneath of the cleaner head of FIG. 1.
Figure 3:
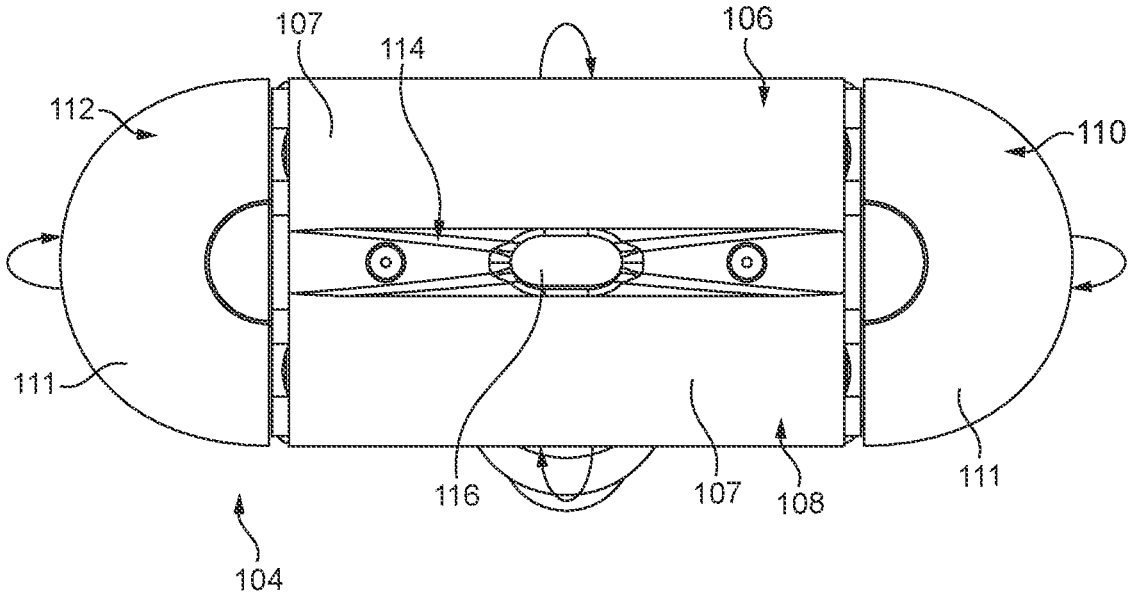
FIG. 3 shows an underside view of the cleaner head of FIGS. 1 and 2.

FIGS. 1 to 3 show views of a cleaner head 100 for a vacuum cleaner. The cleaner head 100 comprises a housing 102 which houses a brushbar arrangement 104. The brushbar arrangement 104 includes first elongate portion 106 located at the front of the cleaner head, a second elongate portion 108 located at the back of the cleaner head, a first curved portion 110 located on the right hand side of the cleaner head and second curved portion 112 located on the left hand side of the cleaner head. The first elongate portion 106 and the second elongate portion 108 are straight or substantially straight. The brush bar arrangement 104 surrounds a suction region 114.

In an embodiment, the second curved portion 112 may be omitted. In this case, the brushbar portion partially extends around the suction region 114.

The second elongate portion 108 and the suction region 114 can be seen from the rear perspective of the cleaner head 100. As can be seen from FIG. 2, the brushbar arrangement 104 surrounds the suction region 114. The suction region 114 is downward facing. Debris, such as dirt and dust, which has been agitated by the brushbar arrangement enters the suction region 114.

As can be seen from the perspective of FIG. 3, the suction region 114 includes a suction port 116. In some embodiments, more than one suction port may be included in the suction region 114. In alternative embodiments, the suction region 114 may include a suction channel in lieu of the suction port. Debris entering the suction region 114 enters through the suction port 116 and is separated by a separation means (See FIG. 14) of a vacuum cleaner to which the cleaner head is attached.

One or more of the brushbar portions may have a set of bristles on their respective outer surfaces. The bristles help agitate debris from the floor surface.

In the figures, the first elongate portion 106 and the second elongate portion 108 are provided with bristles 107. The bristles 107 may be in the form of individual strands brought together to make tufts or rows, or the bristles 107 may instead be in the form of pieces of a resiliently deformable material. The bristles 107 may cover all of the outer surface of the elongate portions or may take the form of lines, stripes, helical formations, other patterns or any combination thereof. The bristles 107 may comprise one or more or a combination of continuous nylon bristles, tufted nylon bristles, and/or carbon fibre bristles. The resiliently deformable material may, for example, be a tufted material having a short dense pile and may be formed by filaments woven to a fabric substrate. The filaments of the pile may be made from nylon, or other suitable material having a relatively low stiffness. The stiffness of a tufted sealing material will depend on the elastic properties of the material, the filament diameter, filament length and pile density. The tufted material may for example be made from nylon having a filament diameter of between 30 μm and 50 μm (preferably 30 μm), a filament length of 0.005 m and a pile density of 60,000 filaments/25 $mm^2$. The resiliently deformable material need not be a tufted material, but could be a foam material such as a closed cell foam material or other suitable material.

The bristles 107 on the first elongate portion 106 and the bristles on the second elongate portion 108 may be formed in the same way and made of the same material. Alternatively, the bristles 107 formed on the first elongate portion 106 and the bristles formed on the second elongate portion 108 may be formed in a different way and may be made of a different material.

In the figures the first curved portion 110 and the second curved portion 112 are also provided with bristles 111. The bristles 111 provided on the first and second curved portion are more deformable than the bristles 107 provided on the first and second elongate portions. Alternatively, the bristles 111 may be formed from the same materials as described above in relation to the first and second elongate portions. The bristles 111 may be longer than the bristles 107. Further, the bristles 111 may be spaced evenly apart.

The bristles formed on each of the brushbar portions may be formed in the same way and made of the same material. Alternatively, the bristles formed on each of the brushbar portions may be formed in a different way and made of a different material. Further, bristles formed on a subset of the brushbar portions may be different from bristles formed on another subset of the brushbar portions.

As the bristles 111 on the first curved portion 110 and the second curved portion 112 rotate there will be a cycle of the bristles 111 becoming more densely packed and then less densely packed. As the bristles 111 become more densely packed together at the innermost point of their rotation, the bristle material will be compressed and as the bristles 111 become less densely packed, at the outermost point of their rotation, the bristle material will stretch. The cycle of compressing and stretching the bristle material will negatively impact the integrity of the bristle material. To overcome this problem, the bristles 111 are optionally made from an elastic material. Alternatively, the bristle material may be corrugated to account for the compression and the stretching. In an alternative embodiment the bristles 111 may be in the form of a deformable sleeve, for example a woven sleeve, which can stretch and compress as it turns.

During use, a drive assembly (described in detail below) rotates the first elongate portion 106 and the first curved portion 110. Alternatively, the drive assembly may also rotate the second elongate portion 108 and the second curved portion 112. The brushbar arrangement 104 acts to agitate debris on a floor surface that is being cleaned. In a preferred embodiment, each of the first elongate portion 106, the second elongate portion 108, the first curved portion 110 and the second curved portion 112 are rotated by the drive assembly. The rotation direction (as shown by arrows in FIG. 3) is such that debris is agitated and swept by the bristles of the brushbar arrangement 104 toward the suction region 114 and the suction port 116. Advantageously, debris is agitated inwardly toward the suction region from all directions around the brushbar arrangement 104. Therefore, debris can be picked up from all directions and the pickup performance of the vacuum cleaner is improved. Additionally, loose debris that has been agitated from the floor by the brushbar arrangement 104 is trapped in the suction region 114 on all sides by the brushbar arrangement and forced into the suction region 114 and ultimately into the suction port 116. Therefore the debris is more likely to be successfully picked up from the floor surface. Therefore, the pickup performance is improved. Further, since the bristles provided on the first curved portion 110 and the second curved portion 112 are more deformable than the bristles provided on the first elongate portion 106 and the second elongate portion 108, the bristles on the first curved portion 110 and the second curved portion 112 are able to deform into corners when, for example, the vacuum cleaner is being used to clean a corner of a room. The added deformability of the curved portions 110, 112 allow the cleaner head to more effectively clean corners. These advantages improve the pickup performance of the cleaner head.

The rotational motion of each brushbar portion can be described with reference to a point on the surface on one of the brushbar portions. A point on the outer surface and at the top of one or more of the brushbar portions may first rotate downwardly towards the floor surface, then inwardly toward the suction region, followed by upwardly along the inner surface to the top of the brushbar portion before, finally rotating outwardly (away from the suction region) to the point on the outer surface at the top of the brushbar portion at which it started. The described movement is then repeated causing the brushbar portion to continuously rotate. This motion acts to rotate the brushbar portion in such a way that debris is agitated from the floor surface toward the suction region. Therefore, allowing debris to be picked up by the vacuum cleaner.

In a preferred embodiment, each of the brushbar portions rotate as described above. Therefore the entire brushbar arrangement rotates in such a way that debris is agitated from the floor surface toward the suction region.

In an alternative embodiment the rotation direction of the one or more brushbar portions may be reversed. In this regard, a point on the outer surface and at the top of one or more of the brushbar portions may first rotate inwardly toward the suction region, then downwardly toward the floor surface, followed by outwardly (away from the suction region) and finally upwardly until it reaches the point in which it started. This motion is then repeated causing continuous rotation.

In an embodiment, at least two of the brushbar portions may rotate at the same speed. In a preferred embodiment, each of the brushbar portions may be configured to rotate at the same speed. In an alternative embodiment each of the brushbar portions may rotate at different speeds.

Figure 4A:
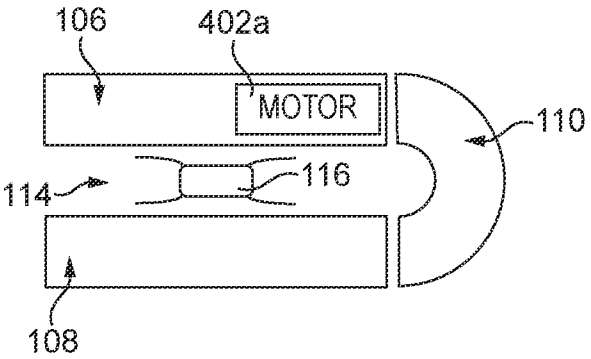
FIGS. 4A to 4F show various embodiments of drive assemblies of the cleaner head of FIGS. 1, 2 and 3.
Figure 4B:
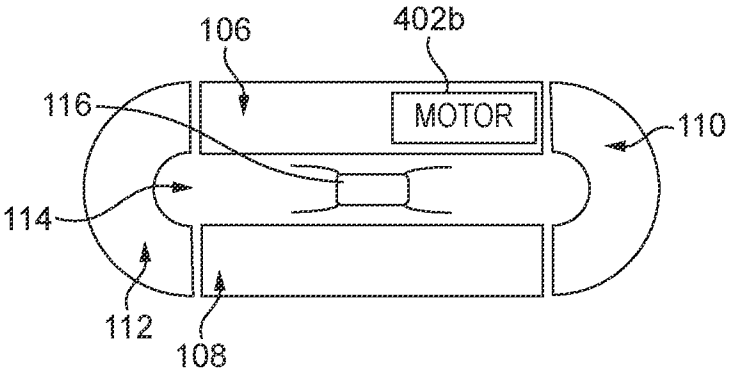
Figure 4C:
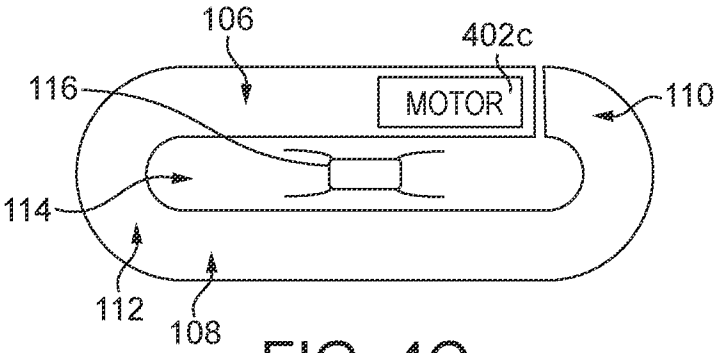
Figure 4D:
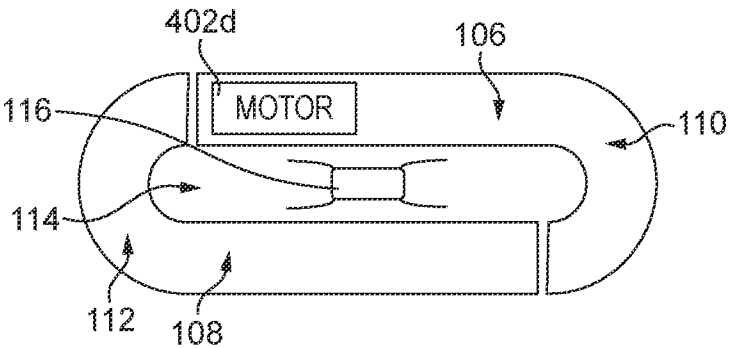
Figure 4F:
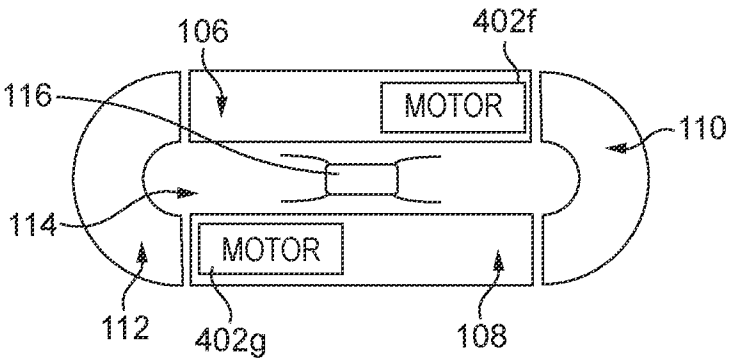
Figure 4E:
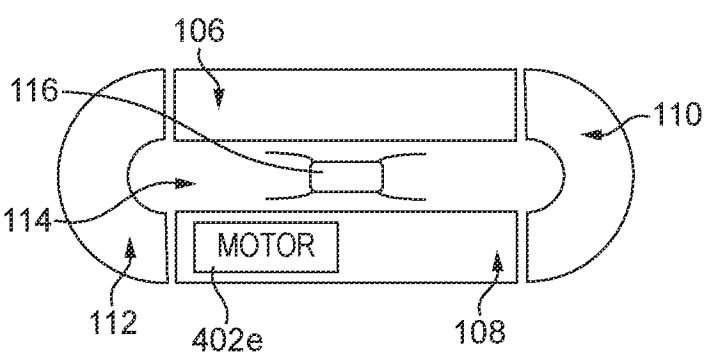

FIGS. 4A to 4F disclose various drive assembly embodiments. FIGS. 4A to 4D show a motor 402*a-d* housed in the first elongate portion 106. FIG. 4E shows a motor 402*e* housed in the second elongate portion 108. FIG. 4F shows a first motor 402*f* housed in the first elongate portion 106 and a second motor 402*g* housed in the second elongate portion 108.

Referring to FIG. 4A, in an embodiment, motor 402*a* is located in the first elongate portion 106 and drives the first curved portion 110 and at least one of the first elongate portion 106 and the second elongate portion 108. Alternatively, the motor 402*a* drives each of the first curved portion 110, the first elongate portion 106 and the second elongate portion 108.

Referring to FIG. 4B, in an embodiment, motor 402*b* is located in the first elongate portion 106 and drives the first curved portion 110 and at least one of the first elongate portion 106 and the second elongate portion 108. Alternatively, the motor 402*b* drives each of the first curved portion 110, the first elongate portion 106 and the second elongate portion 108. In a further embodiment, the motor 402*b* drives each of the first elongate portion 106, the second elongate portion 108, the first curved portion 110 and the second curved portion 112.

Referring to FIG. 4C, the first elongate portion 106, the first curved portion 110, the second elongate portion 108 and the second curved portion 112 are formed of a single piece in an obround shape. The motor 402*c* drives each of the first elongate portion 106, first curved portion 110, the second elongate portion 108 and the second curved portion 112.

Referring to FIG. 4D, the first elongate portion 106 and the first curved portion 110 are formed in a single piece forming a hook-shape. The second elongate portion 108 and the second curved portion 112 are formed in a single piece forming another hook shape. The two hook-shaped pieces are arranged to form an obround. A motor 402*d* is located in the first elongate portion 106 and drives the first elongate portion 106 and the first curved portion 110. In an alternative embodiment, the motor 402*d* drives the first elongate portion 106, the first curved portion 110, the second elongate portion 108 and the second curved portion 112.

Referring to FIG. 4E, in an embodiment, motor 402*e* is located in the second elongate portion 108 and drives the first curved portion 110 and at least one of the first elongate portion 106 and the second elongate portion 108. Alternatively, the motor 402*e* drives each of the first curved portion 110, the first elongate portion 106 and the second elongate portion 108. In a further embodiment, the motor 402*e* drives each of the first elongate portion 106, the second elongate portion 108, the first curved portion 110 and the second curved portion 112.

Placing a single motor in the brushbar arrangement 104 allows valuable space in the rest of the vacuum cleaner to be saved. Further, using only a single motor to drive and rotate the brushbar arrangement 104 represents a space and weight saving in the cleaner head compared to using two or more motors.

Referring to FIG. 4F, motor 402*f* drives the first elongate portion 106 and the first curved portion 110. The motor 402*f* drives the second elongate portion 108 and, optionally, the second curved portion 112. Alternatively, a motor 402*g* drives the first elongate portion 106 and the second curved portion 112 and the motor 402*g* drives the second elongate portion 108 and the first curved portion 110.

Using two motors instead of a single motor to rotate and drive the brushbar arrangement 104 allows more control over which portions of the brushbar are rotated. Further, it allows the speeds of different brushbar portions to be controlled. Further, there may be reasons why only a subset of the brushbar portions will need to be rotated and so only a single motor will need to be used. For example, when the vacuum cleaner is low on battery or running in an "eco" or a low power mode.

The skilled person would understand that the obround shape of the brushbar arrangement 104 can be formed of any number of portions. Further, the skilled person would understand that a motor can be placed at any position within the brushbar arrangement 104 or outside of the brushbar arrangement 104 to drive the first curved portion 110 and at least one of the first elongate portion 106 and the second elongate portion 108.

In an alternative embodiment, the brushbar arrangement 104 is formed in a single piece forming a complete obround shape. For example, the brushbar arrangement may be formed in a single assembly.

Although not shown, an energy storage device (for example, a battery) used for powering any one of the motors may also be housed in the brushbar arrangement 104. For example, a battery for powering a motor located in the first elongate portion 106 may be also be located in the first elongate portion 106. This allows valuable space to be saved in the rest of the vacuum cleaner.

Figure 5B:
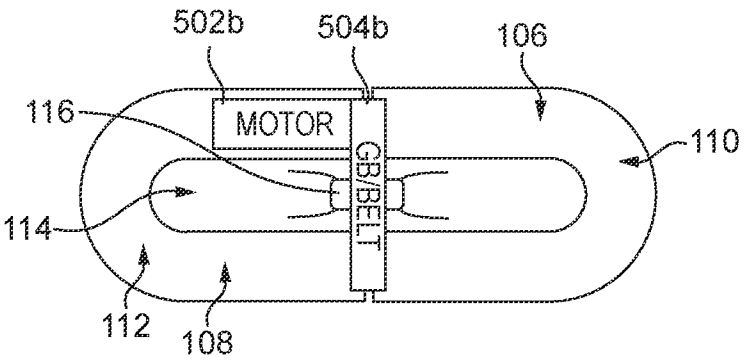
FIGS. 5A to 5C show various embodiments of drive assemblies of the cleaner head of FIGS. 1, 2 and 3.
Figure 5A:
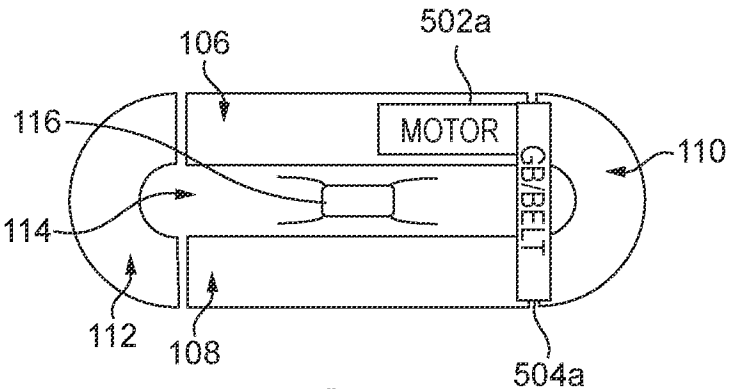
Figure 5C:
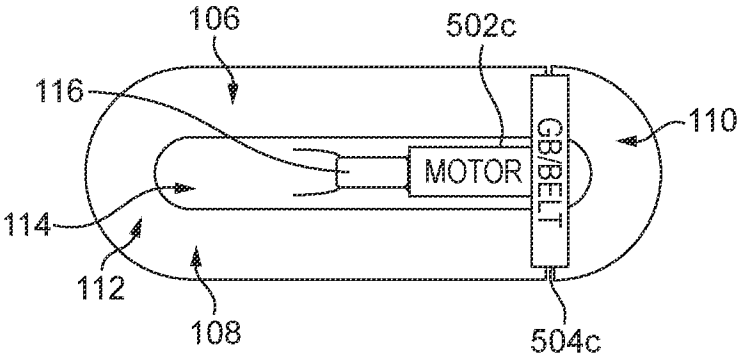

FIGS. 5A to 5C show examples of various alternative drive assembly embodiments. FIG. 5A shows a motor 502*a*, housed in the first elongate portion 106, which drives the first elongate portion 106. The motor also drives a belt and/or gearbox assembly 504, which causes rotation of the first curved portion 112 and, optionally, the second elongate portion 108. The drive belt is located on the right hand side of the cleaner head. Preferably, the motor 502*a* and gearbox assembly 504*a* causes rotation of the first elongate portion 106, the first curved portion 110, the second elongate portion 108 and the second curved portion 112.

Alternatively, the motor 502*a* can be housed in the second elongate portion 108 and drive a belt and/or gearbox assembly 504*a* that causes rotation of the first elongate portion 106 and the first curved portion 110 and, optionally, the second elongate portion 108 and the second curved portion 112.

FIG. 5B shows an alternative brushbar arrangement 104. The brushbar arrangement is obround and formed of two "u" shaped regions. The motor 502*b* housed in the first elongate portion 106 that drives the first elongate portion 106. The motor also drives a belt and/or gearbox 504*b*, which causes rotation of the first curved portion 112, the second elongate portion 108 and the second curved portion 112. The belt and/or gearbox assembly 504*b* is located in a central region of the cleaner head between the ends of the two "u" shaped portions. Alternatively, the motor 502*b* can be housed in the second elongate portion 108 and drive a belt and/or gearbox assembly that causes rotation of the first elongate portion 106 and the first curved portion 110 and the second curved portion 110.

FIG. 5C shows a motor 502*c* housed outside of the brushbar arrangement and instead located in or under the suction region 114. The motor 502*c* drives a belt and/or gearbox assembly 504*c* that causes the rotation of the first elongate portion 106, the second elongate portion 108, the first curved portion 110 and the second curved portion 112.

The skilled person would understand that the motor and/or belt and/or gearbox described with reference to FIGS. 4A to 4F and 5A to 5C can be used to cause rotation of the first elongate portion 106, second elongate portion 108, first curved portion 110 and/or the second curved portion 112 in any combination.

Figure 6B:
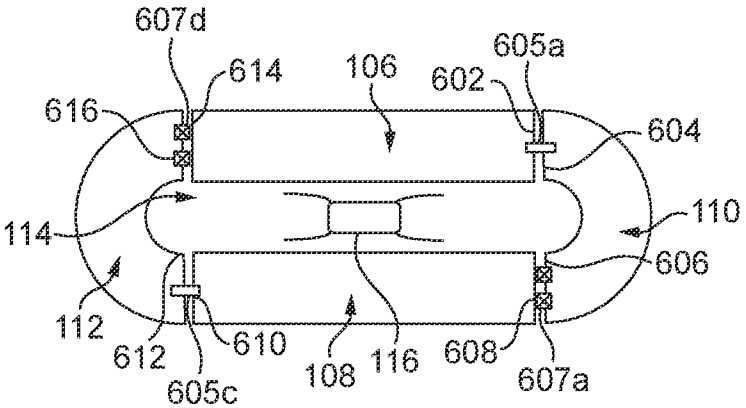
FIGS. 6A and 6B show embodiments of connection arrangements between portions of the brushbar arrangement of the cleaner head of FIGS. 1, 2 and 3.
Figure 6A:
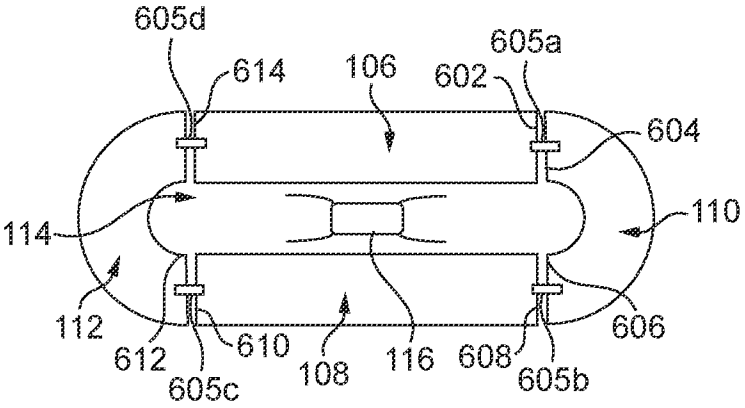

FIGS. 6A to 6C show various connection arrangements between the portions of the brushbar arrangement 104. The portions are connected to each other by either fixed connections where the drive generated by the motor is transmitted from a first portion to a second portion (for example the first elongate portion 106 and first curved portion 110) or the portions are connected to each other by bearings. In an alternative embodiment, the portions of the brushbar arrangement are attached to a chassis of the cleaner head, For example, by bearings or a fixed connection.

FIG. 6A shows a first end 602 of the first elongate portion 106 which is connected to a first end 604 of the first curved portion 110 with a fixed connection 605*a*. The first curved portion 110 is located between the first end 602 of the first elongate portion 106 and a first end 608 of the second elongate portion 108. A second end 606 of the first curved portion 110 is connected to the first end 608 of the second elongate portion 108 with a fixed connection 605*b*. A second end 610 of the second elongate portion 108 is connected to a first end 612 of the second curved portion 112 with a fixed connection 605*c*. The second curved portion 112 is located between the second end 610 of the second elongate portion 108 and a second end 614 of the first elongate portion 106. A second end 616 of the second curved portion 112 is connected to the second end 614 of the first elongate portion 106 with a fixed connection 605*d*. The suction region 114 and the suction port 116 is surrounded on all sides by the brushbar arrangement. In this embodiment, one motor or one motor and belt and/or gearbox assembly would rotate all of the portions. All of the portions would be rotated at the same speed.

FIG. 6B shows a first end 602 the first elongate portion 106 is connected to a first end 604 of the first curved portion 110 with a fixed connection 605*a*. The first curved portion 110 is located between the first end 602 of the first elongate portion 106 and a first end 608 of the second elongate portion 108. A second end 606 of the first curved portion 110 is connected to the first end 608 of the second elongate portion 108 with a bearing connection 607*a*. A second end 610 of the second elongate portion 108 is connected to a first end 612 of the second curved portion 112 with a fixed connection 605*c*. The second curved portion 112 is located between the second end 610 of the second elongate portion 108 and a second end 614 of the first elongate portion 106. A second end 616 of the second curved portion 112 is connected to the second end 614 of the first elongate portion 106 with a bearing connection 607*b*. The suction region 114 and the suction port 116 is surrounded on all sides by the brushbar arrangement The fixed connections 605*a-d* cause the brushbar portions attached to the fixed connections to be driven directly by the drive assembly. In other words, when torque is applied to a portion of brushbar arrangement it is transferred via the fixed connection to an adjacent portion of the brushbar arrangement. The bearings 607*a* and 607*b* allow the brushbar portions to rotate freely about the end with the bearings.

The skilled person would understand that any portion of the brushbar arrangement may be connected to an adjacent portion with either a fixed connection or a bearing connection depending on which portions they wanted to rotate and how many motors they wanted to use.

The brushbar arrangement 104 can be formed in any number of portions with any number of fixed connections and bearing connections. The fixed connections and the bearing connections can be at any position on the brush bar arrangement. In an embodiment, the first elongate portion 106 and/or the second elongate portion 108 may be split into two or more sub-portions each connected by either a fixed connection or bearing connection. Similarly, the first curved portion 110 and/or the second curved portion 112 can be split into a two or more sub-portions each connected by either a fixed connection or a bearing connection.

In an embodiment, the drive assembly may comprise a fixed drive connection between the first curved portion and the first elongate portion and may further comprise a bearing arrangement between the first curved portion and the second elongate portion. The fixed drive connection may be driven by the drive assembly. In such an embodiment the first elongate portion and the first curved portion are driven by the first motor whilst the second elongate portion is not driven by the first motor.

Alternatively there may be a fixed drive connection between the first curved portion and the second elongate portion such that the motor in the first elongate portion can drive the first elongate portion, the first curved portion and the second curved portion. There may also be a further fixed drive or a bearing between the second elongate portion and the second curved portion. In the embodiment with the fixed drive between the second elongate portion and the second curved portion the second curved portion can also be driven by the first motor. With a bearing in this position however the second curved portion will not be driven by the first motor. Using a single motor to drive all portions of the brushbar is advantageous as the arrangement is cost effective and all portions will be driven at the same speed.

FIGS. 7A to 7D show an embodiment of the first curved portion or the second curved portion.

Figure 7A:
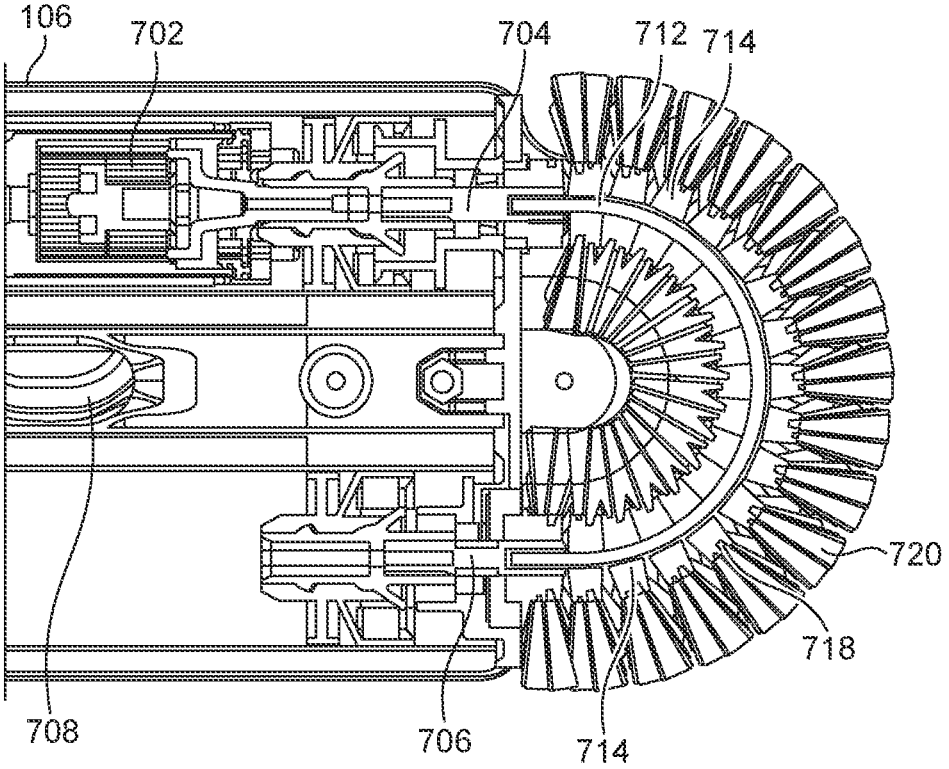
FIG. 7A to 7D show an embodiment of the first curved portion or the second curved portion of the cleaner head of FIGS. 1, 2 and 3.
Figure 7B:
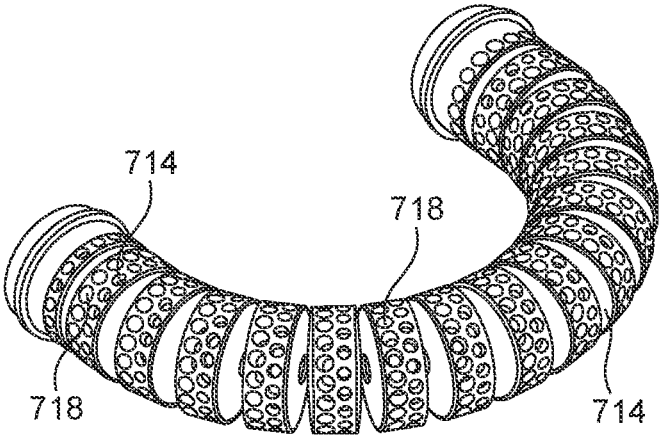
Figure 7C:
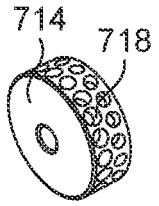
Figure 7D:
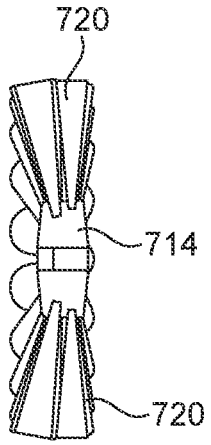

FIG. 7A shows a cross section of a region of the brushbar arrangement. The first elongate portion 106 comprises a motor 702. The first end 602 of the first elongate portion 106 is connected to the first end 604 of the first curved portion 110 with a fixed connection 704. The second end 606 of the first curved portion 110 is connected to the first end 608 of the second elongate portion 108 with a fixed connection 706. Although not shown, a second end of the second elongate portion 108 is connected to a first end of the second curved portion via a fixed connection and a second end of the second curved portion is connected to the second of the first elongate portion via a fixed connection in the same manner as shown for the first ends. The brushbar arrangement at least partially extends around the suction region 708.

The first curved portion 110 comprises a core 712 and a plurality of disc-shaped components 714 arranged along the core 712. Each of the components 714 has a plurality of holes 718. Each of the holes is used to secure a bristle tuft 720 to the component. Each bristle tuft 720 is secured to the component in a known way (for example, by the use of an adhesive).

During use, torque is applied by the motor 702 to the first elongate portion 106 and transferred to the core 712 of first curved portion 110 via the fixed connection 704. This causes the core 712 to rotate along with each of the disc-shaped components 714. The torque is further transferred to the second elongate portion 108 via fixed connection 706 thereby causing the second elongate portion 108 to rotate. Although not shown, the torque is further transferred to the second curved portion 112 via a fixed connection thereby causing the second curved portion 112 to rotate.

Each brushbar portion is rotated in a direction that causes debris to be agitated toward the suction region 708. The brushbar portions therefore sweep inwardly when in contact with a floor to be cleaned.

Figure 8A:
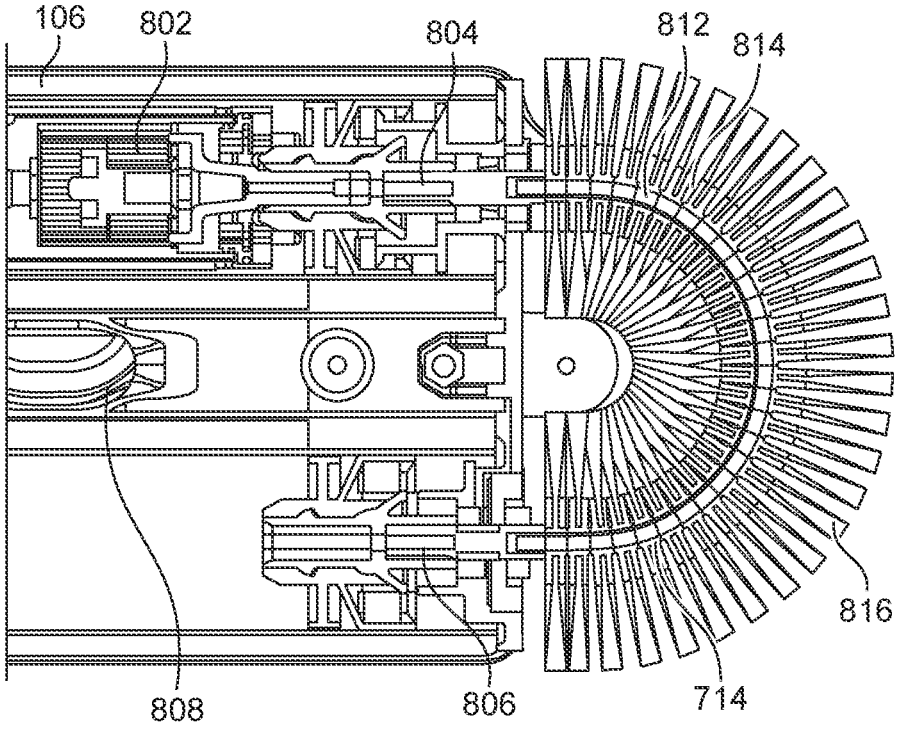
FIGS. 8A to 8C show an embodiment of the first curved portion or the second curved portion of the cleaner head of FIGS. 1, 2 and 3.
Figure 8B:
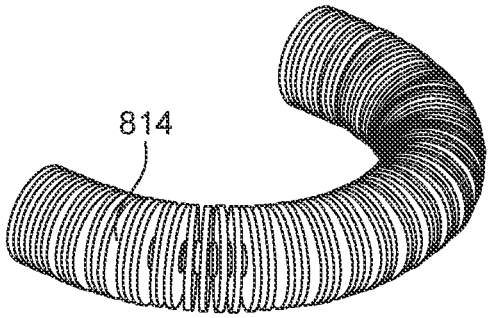
Figure 8C:
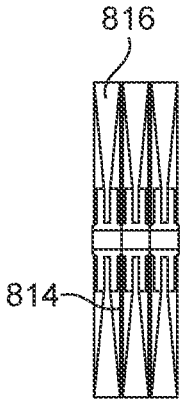

FIG. 8A to 8C show an alternative embodiment of the first curved portion or the second curved portion.

FIG. 8A shows a cross section of the brushbar arrangement. The first elongate portion 106 comprises a motor 802. The first end 602 of the first elongate portion 106 is connected to the first end 604 of the first curved portion 110 with a fixed connection 804. The second end 606 of the first curved portion 110 is connected to the first end 608 of the second elongate portion 108 with a fixed connection 806. Although not shown, a second end of the second elongate portion 108 is connected to a first end of the second curved portion 112 via a fixed connection and a second end of the second curved portion 112 is connected to the second end of the first elongate portion 106 via a fixed connection in the same manner as shown for the first ends. The brushbar arrangement at least partially extends around the suction region 808.

FIGS. 8A to 8C show an embodiment of the first curved portion or the second curved portion. The curved portion comprises a core 812 and a plurality of flat discs 814 arranged along the core 812. Bristles 816 are held in place between the flat discs 814. The bristles 816 are secured to the discs in a known way (for example, by the use of an adhesive).

During use, torque is applied to the first elongate portion 106 and transferred to the core 812 of first curved portion 110 via the fixed connection 804. This causes the core 812 to rotate along with each of the flat discs 814. The torque is further transferred to the second elongate portion 108 via fixed connection 806 thereby causing the second elongate portion 108 to rotate. Although not shown, the torque is further transferred to the second curved portion 112 via a fixed connection thereby causing the second curved portion 112 to rotate.

Each brushbar portion is rotated in a direction that causes debris to be agitated toward the suction region 808.

Figure 9A:
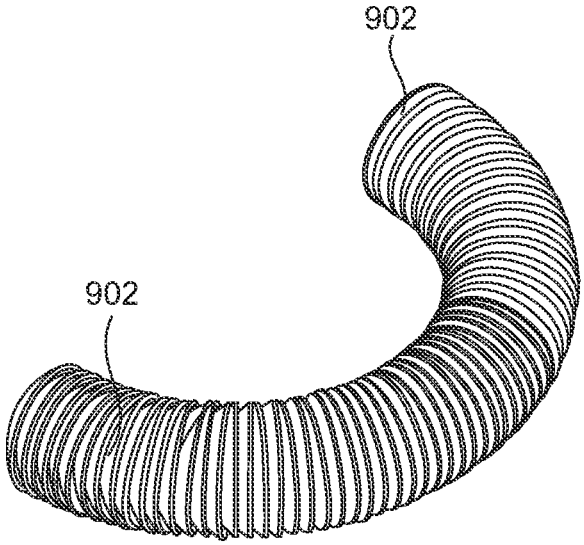
FIGS. 9A and 9B show an embodiment of the first curved portion or the second curved portion of the cleaner head of FIGS. 1, 2 and 3.
Figure 9B:
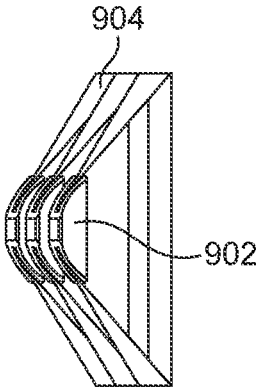

FIGS. 9A and 9B show an alternative embodiment, the curved portion may comprise a core and plurality of dome-shaped components 902 arranged along the core. Bristles 904 are held between the dome-shaped components 902 such that the bristles 904 are angled. Advantageously, this creates the effect of hiding the core and creating a denser bristle appearance.

Figure 10A:
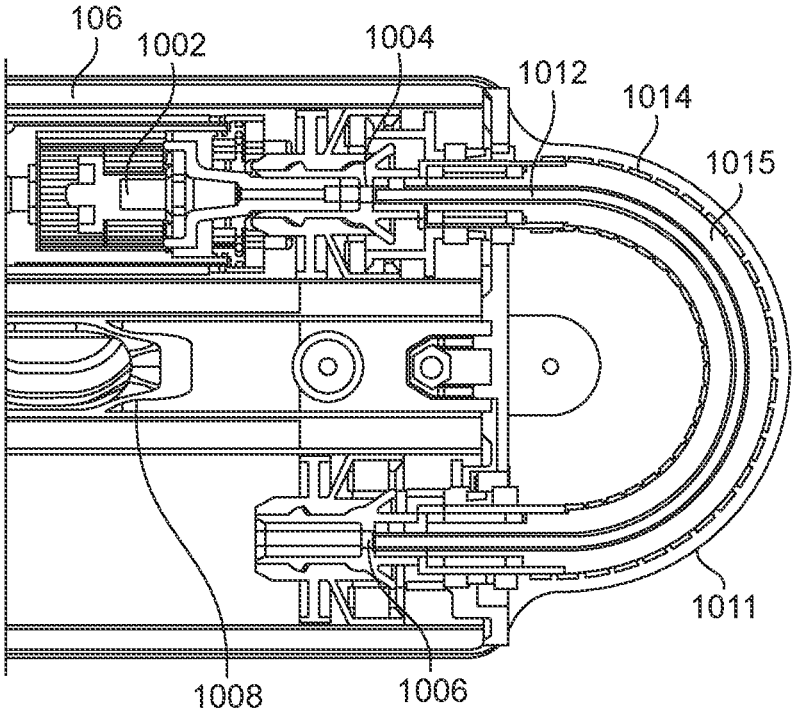
FIGS. 10A and 10B show an embodiment of the first curved portion or the second curved portion of the cleaner head of FIGS. 1, 2 and 3.
Figure 10B:
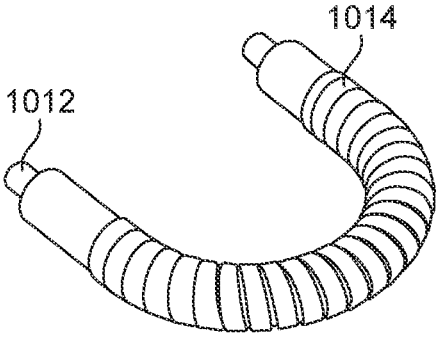

FIGS. 10A and 10B show an alternative embodiment of the first curved portion or the second curved portion.

FIG. 10A shows a cross section of the brushbar arrangement. The first elongate portion 106 comprises a motor 1002. The first end 602 of the first elongate portion 106 is connected to the first end 604 of the first curved portion 110 with a fixed connection 1004. The second end 606 of the first curved portion 110 is connected to the first end 608 of the second elongate portion 108 with a fixed connection 1006. Although not shown, a second end of the second elongate portion 108 is connected to a first end of the second curved portion via a fixed connection and a second end of the second curved portion is connected to the second end of the first elongate portion via a fixed connection in the same manner as shown for the first ends. The brushbar arrangement at least partially extends around the suction region 1008.

The curved portion may comprise a rotating core 1012. A sleeve, for example a helical sleeve 1014 is arranged over the core 1012 with a static intermediary component 1015 in between the helical sleeve 1014 and the core 1012. Bristles 1011 are attached to the sleeve in a known way (for example, by the use of an adhesive or by winding). FIG. 10B shows the static core 1012 and the helical sleeve 1014.

During use, torque is applied by the motor 1002 to the first elongate portion 106 and transferred to core 1012 and to the helical sleeve 1014 of first curved portion 110 via the fixed connection 804. This causes the helical sleeve 1014 to rotate around the core 1012. The torque is further transferred to the second elongate portion 108 via fixed connection 806 thereby causing the second elongate portion 108 to rotate. Although not shown, the torque is further transferred to a helical sleeve of the second curved portion 112 via the fixed connection thereby causing the second curved portion 112 to rotate.

Each brushbar portion is rotated in a direction that causes debris to be agitated toward the suction region.

Figure 11C:
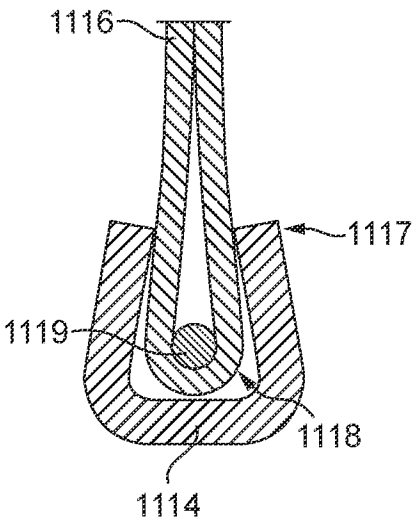
FIGS. 11A to 11C show an embodiment of the first curved portion or the second curved portion of the cleaner head of FIGS. 1, 2 and 3.
Figure 11B:
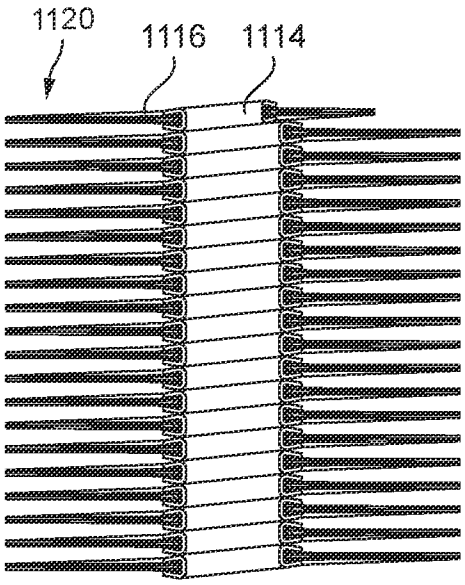
Figure 11A:
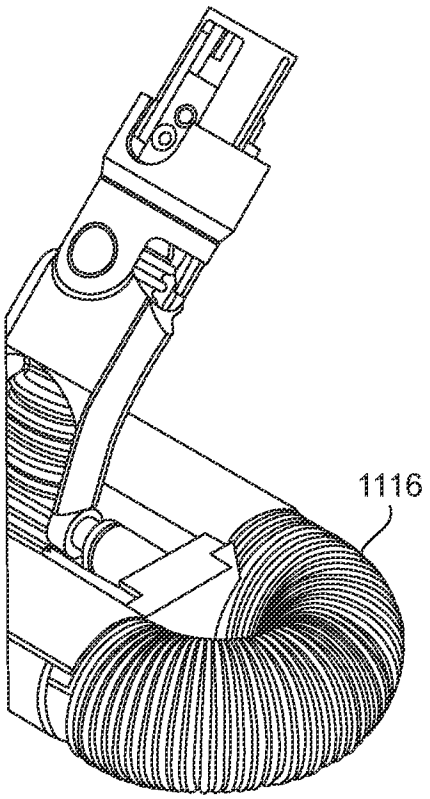

FIGS. 11A to 11C show an alternative embodiment of the first curved portion or the second curved portion. FIG. 11A shows the curved portion on the cleaner head, FIG. 11B shows part of the curved portion in isolation (and prior to being positioned into a curve), and FIG. 11C shows an enlarged cross section of the part of FIG. 11B.

Around the core (not shown), which may be rotatable or stationary, is wound a helical carrier 1114 which supports an array of bristles 1116 projecting therefrom. In this specific embodiment the carrier 1114 is made of sheet metal such as steel, which has been stamped or bent to give it a generally U-shaped cross section with a narrowed mouth 1117, before then being formed into a helix. In this case the carrier 1114 is made from spring steel but any other suitable material, such as a polymer, may be used in other embodiments.

The bristles 1116 in this embodiment form a substantially continuous helical strip with roots 1118 received in the carrier 1114 and tips 1120 projecting radially therefrom. In this specific case the roots 1118 of the bristles encircle a wire 1119 in the channel of the carrier 1114, the wire 1119 and bristle roots 1118 being too wide to pass through the narrowed mouth 1117. In other embodiments, the roots 1118 may be clamped in the narrowed mouth 1117 of the carrier 1114 and/or secured with adhesive, as well of or instead of being secured with the wire 1119. The bristles 1116 may be made from a polymer such as nylon, a carbon filled polymer, a metal and/or carbon fibre, for example.

During use, torque applied directly or indirectly by a motor (not shown) is applied to the carrier 1114. For example, torque may be applied to the core so that it rotates and drives the carrier 1114 to rotate with it, or the carrier may be rotated by the motor around the core while the core remains stationary. As the carrier 1114 rotates, the bristles 1116 rotate similarly, in the same general manner as discussed above regarding bristles which are supported by discs.

In this embodiment the core provides support to the carrier 1114. In a modification of the above embodiment, however, the core may be eliminated and the carrier may be self-supporting. In such a modification, the carrier may be considered to form a rotating core, or the curved portion may be considered not to have a core at all. The carrier not being supported by the core may make it more easily deformed. This can be beneficial, for instance allowing the carrier to flex slightly when knocked or pressed against a surface such as a wall, but can also make the carrier more prone to damage.

In a further modification of the above embodiment, the curved portion may comprise two helical carriers, each supporting a corresponding array of bristles, forming a double-helix. In another modification, whilst in the above embodiment the coils of the carrier are positioned immediately next to one another and contact one another the helical shape of the carrier may instead be "stretched" so that adjacent coils do not touch one another (or touch each other only at the innermost region of the curve).

Figure 12A:
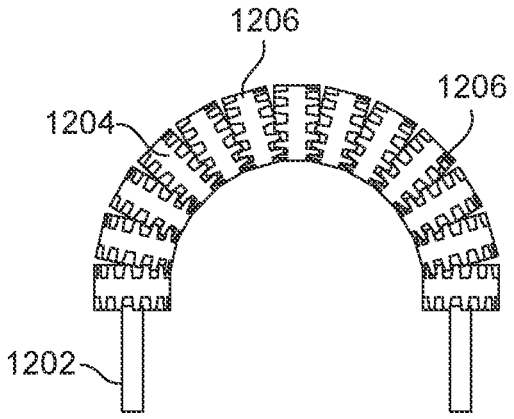
FIGS. 12A and 12B show an embodiment of the first curved portion or the second curved portion of the cleaner head of FIGS. 1, 2 and 3.
Figure 12B:
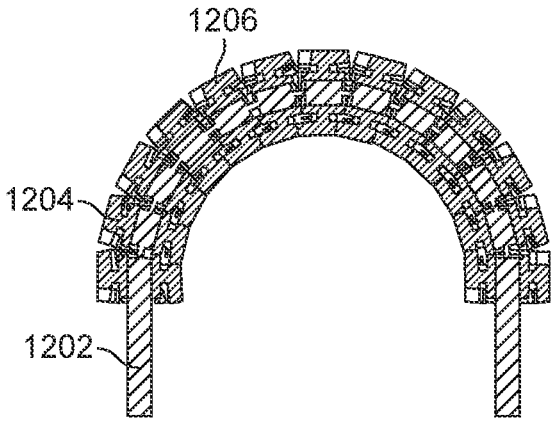

FIG. 12A and shows another embodiment of the first curved portion or the second curved portion. FIG. 12B shows a cross section of FIG. 12A. The curved portion comprises a static core 1202 and a plurality of disc-shaped components 1204 arranged along the core 1202. Each of the disc-shaped components includes a plurality of teeth 1206. The teeth 1206 of one of the components engages with the teeth 1206 of an adjacent component.

During use, the drive assembly (not shown) causes one of the plurality disc-shaped components (for example the first disc shaped component) to rotate and the rotation of the disc shaped component will cause rotation of the adjacent disc shaped component, thereby transferring the torque from the first component to an adjacent component. Each of the disc-shaped components will therefore rotate around the static core 1202.

In an alternative embodiment, the teeth could be replaced with male and female features on each of the disc-shaped components.

In an embodiment, the core is omitted and instead the rotation of the curved portion relies on the torque being transferred from a first component to an adjacent component (e.g. using teeth engagement or male to female engagement).

In an alternative embodiment the helical sleeve may be a spring which is driven by the torque transferred from the first elongate portion to the spring. Alternatively a hollow rotatable drive shaft may be used.

As mentioned above, the core if present may be static such that the components, spring or sleeve rotates around the static core. Alternatively, the core may rotate such that the components, spring or sleeve rotate as the core rotates. In both cases, the rotation causes bristles to agitate debris towards the suction region.

The core may be formed of a rigid material (for example, steel) or a flexible material (for example, a polyamide such as Nylon). In an embodiment, the core may be spring. In another embodiment, the core may be hollow. Alternatively, the core may be solid.

According to each of the above embodiments, the bristles of the curved portions are more deformable than the bristles of the elongate portions. This allows the curved portion to deform into corners of a room. Therefore, the deformable bristles allow for the cleaner head to more effectively clean the corners of a room.

In an embodiment, the bristles of the first curved portion or the second curved portion may be formed in tufts and adhered to the core, components, spring or sleeve. The tufts may poke through holes in the sleeve. Alternatively, the sleeve may be a woven material and the bristles may be woven into the sleeve.

According to any one of the above embodiments, bristles may formed by wrapping a bristle material around the core. Alternatively, the bristles may be overmolded on to the core. Alternatively, bristles may be adhered to the components, sleeve or spring in a known way. The bristles may also be splayed in order to cover the core, therefore, the core may be hidden from view in normal use. The bristles may also be angled in order to hide the core in normal use.

According to any one of the above embodiments, the core may be flexible. The core may have a helical profile or may be a spring. Alternatively, the core may be twisted wires. The twisted wires being used to secure bristles in a helical arrangement.

The first curved portion and the second curved portion are preferably formed in the same way. Alternatively, the first curved portion and the second portion are formed in different ways.

Figure 13:
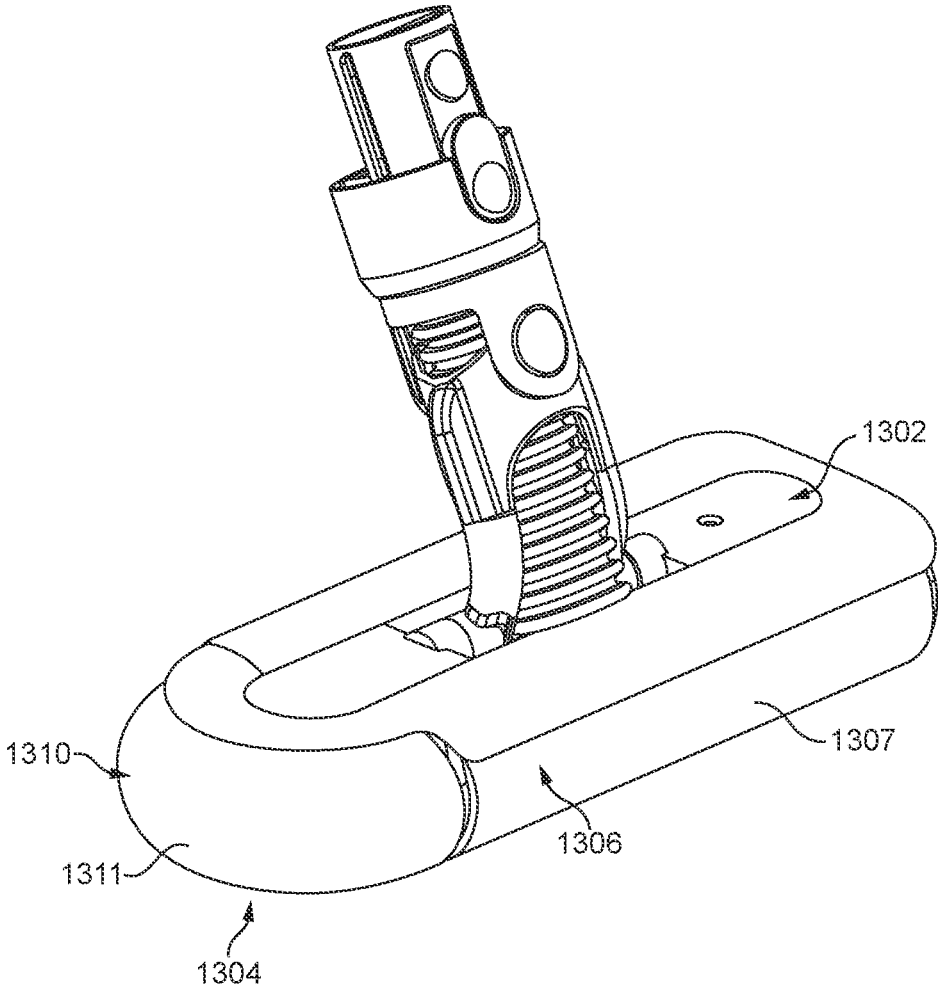
FIG. 13 shows a front perspective of an embodiment of a cleaner head.

FIG. 13 shows a view of a cleaner head for a vacuum cleaner. The cleaner head comprises a housing 1302 which houses a brushbar arrangement 1304. The brushbar arrangement 1304 includes first elongate portion 1306 located at the front of the cleaner head and a first curved portion 1310 located on the right hand side of the cleaner head. The first elongate portion 1306 is straight or substantially straight. The brushbar arrangement 1304 at least partially extends around a suction region. The suction region includes a suction port. The first elongate portion 1306 includes bristles 1307 and the first curved portion includes bristles 1311. Alternatively, the first curved portion 1310 is located on the left hand side of the cleaner head.

During use, a drive assembly (as described above), rotates the first elongate portion 1306 and the first curved portion 1310. The brushbar arrangement 1304 acts to agitate debris on a floor surface that is being cleaned. The rotation direction is such that debris is agitated and swept by the bristles of the brushbar arrangement 1304 toward the suction region. Advantageously, debris is agitated inwardly toward the suction region and the suction port. Therefore, the pickup performance may be improved.

Figure 14:
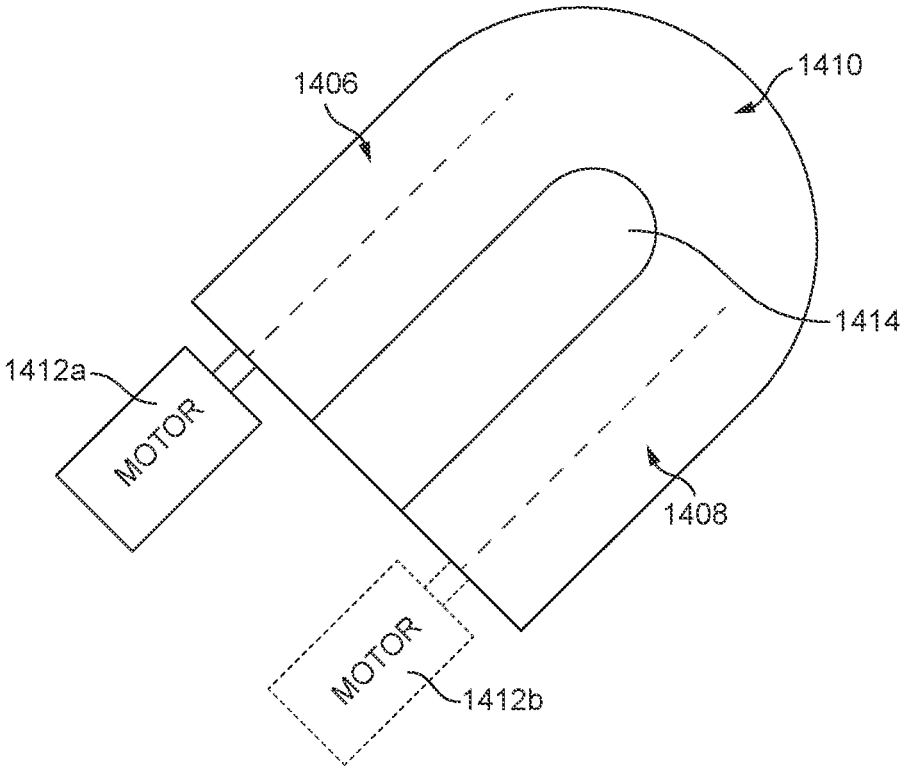
FIG. 14 shows a further embodiment of a cleaner head.

FIG. 14 shows a view of a cleaner head. The cleaner head comprises a brushbar arrangement. The brushbar arrangement includes a first elongate portion 1406, a second elongate portion 1408 located opposite the first elongate portion 1406. The brushbar arrangement also includes a first curved portion 1410 located between a first end of the first elongate portion 1406 and a respective first end of the second elongate portion 1408. The brushbar arrangement 1404 at least partially extends around a suction region 1414.

The cleaner head also includes a first motor 1412*a* located in line with the first elongate portion 1410 but housed outside of the first elongate portion 1406. Alternatively, the first motor 1412*a* may be housed inside of the first elongate portion 1406. In an embodiment, the cleaner head also includes a second motor 1412*b* located in line with the second elongate portion 1408. Alternatively, the second motor may be located inside the second elongate portion 1408.

During use, the first motor 1412*a* rotates the first elongate portion 1406 and the first curved portion 1410. Alternatively, the first motor 1412*a* may also rotate the second elongate portion 1408. The brushbar arrangement acts to agitate debris on a surface that is being cleaned. In a preferred embodiment, each of the first elongate portion 106, the second elongate portion 108, the first curved portion 110 rotated by the first motor 1412*a* and/or the second motor 1412*b*. The rotation direction is such that debris is agitated and swept by the bristles of the brushbar arrangement 104 toward the suction region 1414. Advantageously, debris is agitated inwardly toward the suction region.

In an embodiment, the second motor 1412*b* rotates the second elongate portion 1408 and the first curved portion 1410. Alternatively, the second motor 1412*a* may also rotate the first elongate portion 1406. In another embodiment, the first motor 1412*a* and the second motor 1412*b* cause the first elongate portion 1406, the second elongate portion 1408 and the first curved portion 1410 to rotate.

In an embodiment, a cleaner head comprises a housing which houses a brushbar arrangement. The brushbar arrangement includes first elongate portion located at the front (or, alternatively, the back) of the cleaner head, a first curved portion located on the right hand side of the cleaner head and a second curved portion located on the left hand side of the cleaner head. The first elongate portion is straight or substantially straight. The brushbar arrangement at least partially extends around a suction region. The suction region includes a suction port. The first elongate portion includes bristles and the first and second curved portions include bristles.

During use, a drive assembly (as described above), rotates the first elongate portion and the first curved portion. Alternatively, the drive assembly rotates the first elongate portion and the second curved portion. Alternatively, the drive assembly rotates the first elongate portion, the first curved portion and the second curved portion The brushbar arrangement acts to agitate debris on a floor surface that is being cleaned. The rotation direction is such that debris is agitated and swept by the bristles of the brushbar arrangement toward the suction region. Advantageously, debris is agitated inwardly toward the suction region and the suction port. Therefore, the pickup performance may be improved.

Figure 15:
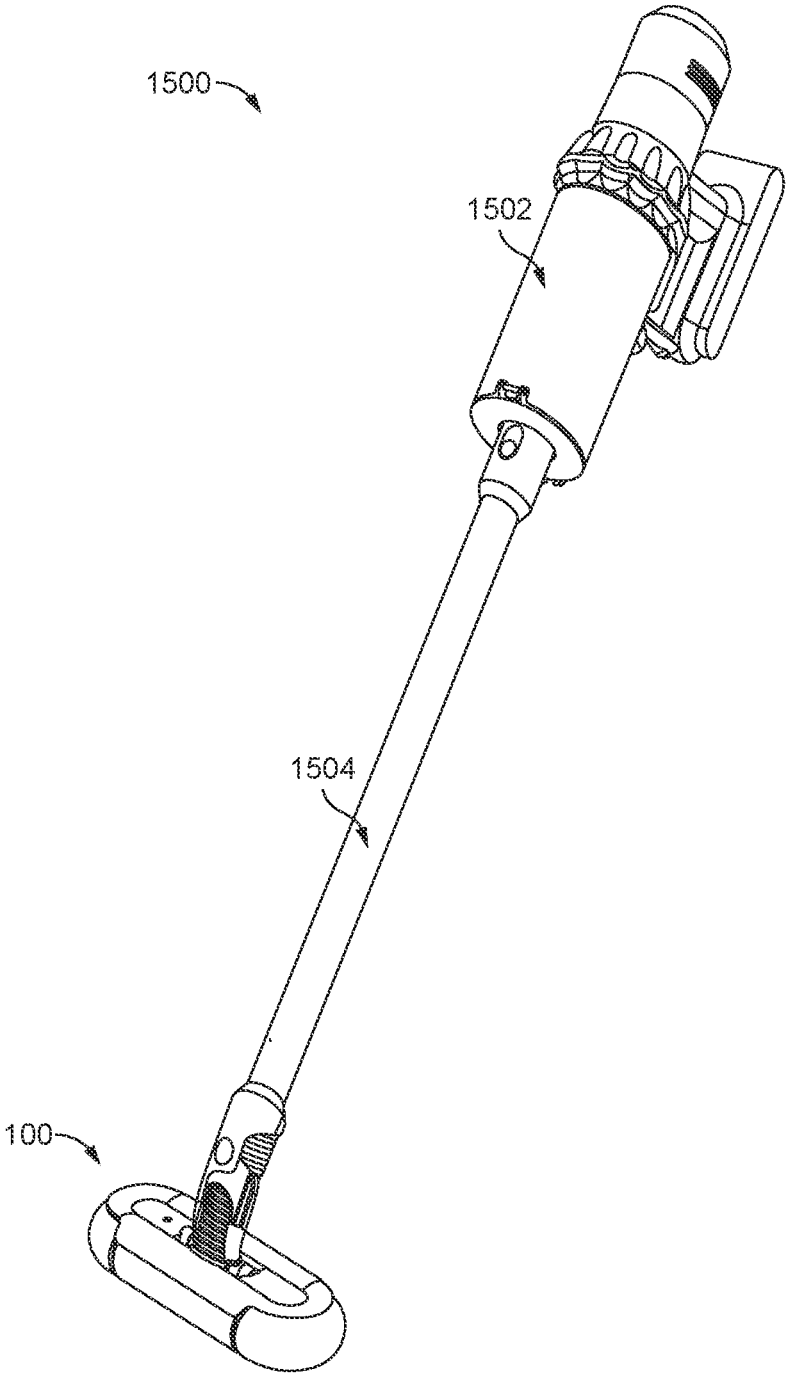
FIG. 15 shows a vacuum cleaner comprising the cleaner head shown in the previous figures.

FIG. 15 shows a vacuum cleaner 1500 in the form of a stick vacuum cleaner which comprises the cleaner head 100 according to the previously described embodiments. The stick vacuum cleaner is formed of a handheld vacuum cleaner 1502 attached to a first end of a wand 1504. The cleaner head 100 is attached to second end of a wand 1504. The embodiment shown is a stick vacuum cleaner, however, the cleaner head could be used on other types of vacuum cleaner, for example an upright vacuum cleaner or a cylinder vacuum cleaner, which is sometimes referred to as a canister or barrel vacuum cleaner.

As will be described below, the cleaner head, or aspects thereof, could be used in conjunction with a cleaner head for a robot vacuum cleaner.

Figure 16:
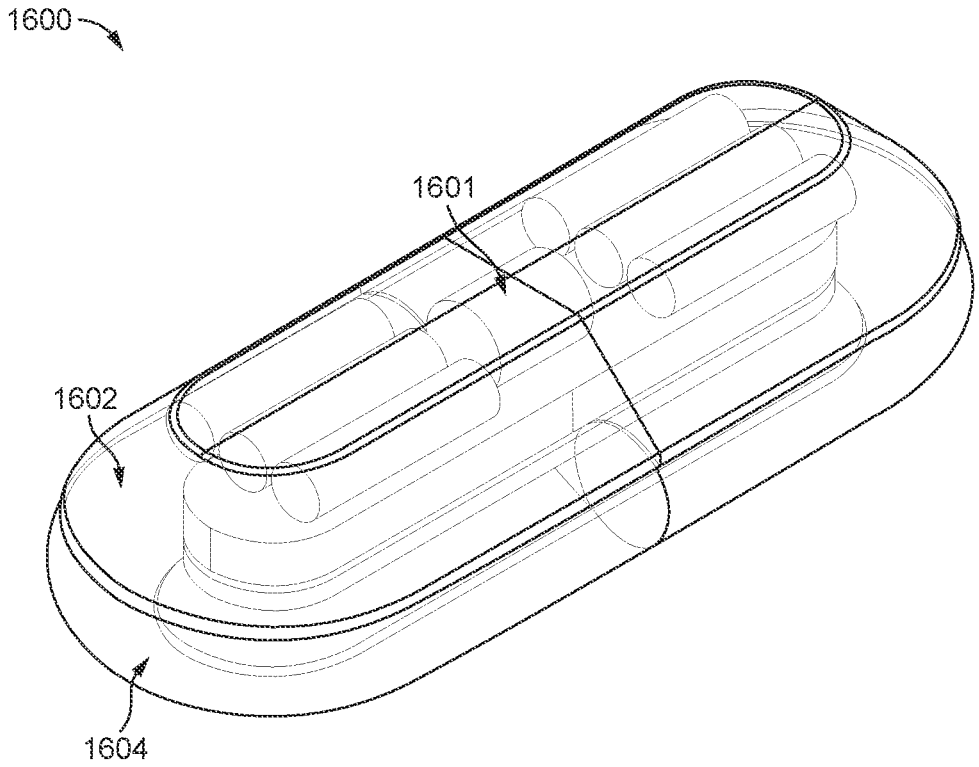
FIG. 16 shows a perspective view of a robot vacuum comprising a cleaner head as shown in the previous figures.

FIG. 16 shows a perspective view of a robotic vacuum cleaner 1600. The robotic vacuum cleaner comprises a main body 1602 and a cleaner head 1604. The main body 1602 houses a navigation system (not shown) which includes wheels. The wheels may be driven to autonomously navigate around an environment. The navigation and movement may be holonomic. The main body 1602 also comprises a suction motor 1601 to draw dirty air and/or debris from the cleaner head, and a dirt separation system that separates dirt from the airflow generated by the suction motor 1601. It will be understood that the robotic vacuum cleaner 1600 will comprise a number of other components and systems that are typical for a robotic vacuum cleaner, however these are not the focus of this invention, and will therefore not be described in any detail herein. For example the robotic vacuum cleaner 1600 may further comprise a vision system, a sensor system, a navigation system, and a power supply such as a battery pack.

Figure 17:
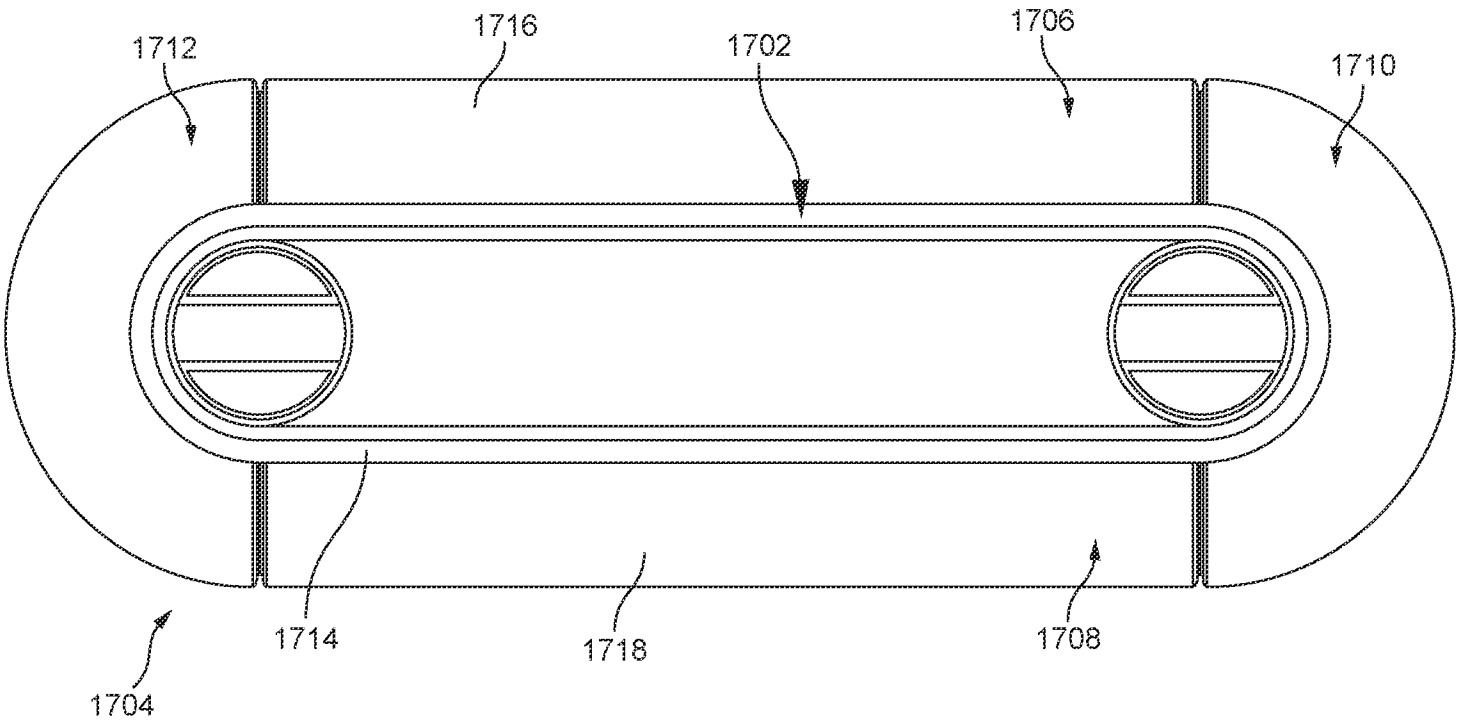
FIG. 17 shows an underside view of the robot vacuum shown in FIG. 15.

FIG. 17 shows an underside view of the robotic cleaner. The cleaner head 1704 shares substantially the same arrangement as the cleaner head of FIGS. 1 to 13. The cleaner head includes a suction region 1702 a brushbar arrangement 1704. The brushbar arrangement 1704 includes first elongate portion 1706 located at the front of the cleaner head, a second elongate portion 1608 located at the back of the cleaner head, a first curved portion 1710 located on the right hand side of the cleaner head and second curved portion 1712 located on the left hand side of the cleaner head. The first elongate portion 1706 and the second elongate portion 1708 are straight or substantially straight. The brushbar arrangement 1704 at least partially extends around a suction region 1702. The suction region 1702 is downward facing through which debris (such as dirt and dust) is able to enter the suction region 1702 defined by the brushbar arrangement 1704. In a preferred embodiment, the brushbar arrangement 1704 completely surrounds the suction region 1702.

The suction region 1702 includes a suction channel 1714. The suction channel extends around the circumference of the suction region 1702. Debris entering the suction region 1702 enters through the suction channel 1714 and is separated by a separation means of the vacuum cleaner. The first elongate portion 1706 and the second elongate portion 1708 are provided with bristles 1716 which preferably extend helically around the length of the elongate portions 1706, 1708. The bristles may comprise one or more or a combination of continuous nylon bristles, tufted nylon bristles, carbon fibre bristles, and resilient material as described in relation to earlier embodiments. The first curved portion 1710 and the second curved portion 1712 are provided with bristles 1718. The bristles provided on the first and second curved portion are more deformable than the bristles provided on the first and second elongate portions. During use, the brushbar arrangement 1704 acts to agitate debris on a floor surface that is being cleaned.

During use, a drive assembly (described in detail above in relation to the earlier embodiments) rotates the first elongate portion 1706 and the second elongate portion 1708 and the drive assembly also rotates the first curved portion 1710 and/or the second curved portion 1712. In a preferred embodiment, each of the first elongate portion 1706, the second elongate portion 1708, the first curved portion 1710 and the second curved portion 1712 are rotated by the drive assembly. The rotation direction is such that debris is agitated and swept by the bristles of the brushbar arrangement 1704 toward the suction region 1702 and the suction channel 1714. Advantageously, debris is agitated inwardly toward the suction region from all directions around the brushbar arrangement 1704. Therefore, debris can be picked up from all direction and the pickup performance of the vacuum cleaner is improved. Additionally, loose debris that has been agitated from the floor by the brushbar arrangement 1704 is trapped in the suction region 1702 on all sides by the brushbar arrangement and forced into the suction region 1702 and ultimately into the suction channel 1714. Therefore the debris is more likely to be successfully picked up from the floor surface. Therefore, the pickup performance is improved. Further, since the bristles provided on the first curved portion 1710 and the second curved portion 1712 are more deformable than the bristles provided on the first elongate portion 1706 and the second elongate portion 1708, the bristles on the first curved portion 1710 and the second curved portion 1712 are able to deform into the corners when, for example, the robot vacuum cleaner is being used to clean a corner of a room. The added deformability of the curved portions 1710, 1712 allow the cleaner head to more effectively clean corners. These advantages improve the pickup performance of the cleaner head.

Although not shown, an energy storage device (for example, a battery) used for powering any one of the motors may also be housed in the brushbar arrangement 1704. For example, a battery for powering a motor located in the first elongate portion 1706 may be also be located in the first elongate portion 1706. This allows valuable space to be saved in the rest of the vacuum cleaner.

The skilled person would understand that the embodiments of the cleaner head described with reference to a stick vacuum cleaner apply equally to the cleaner head described with reference to the robotic vacuum cleaner.

Whilst particular examples and embodiments have thus far been described, it will be understood that various modifications, some of which are already described above, may be made without departing from the scope of the invention as defined by the claims.

The invention claimed is:

1. A cleaner head comprising:

a brushbar arrangement comprising a first elongate portion, and a first curved portion located at a first end of the first elongate portion, wherein the brushbar arrangement at least partially extends around a suction region;

a second elongate portion located opposite the first elongate portion, wherein the first curved portion is located between the first end of the first elongate portion and a respective first end of the second elongate portion; and wherein the drive assembly is further configured to rotate the second elongate portion; and a drive assembly configured to rotate the first curved portion and the first elongate portion wherein the first elongate portion, the second elongate portion, the first curved portion and the second curved portion are arranged to form an obround.

2. The cleaner head according to claim 1, wherein the drive assembly comprises a fixed drive connection between the first curved portion and the first elongate portion.

3. The cleaner head according to claim 1, wherein the drive assembly comprises a first motor and/or gearbox assembly located in the first elongate portion.

4. The cleaner head according to claim 1, wherein the first curved portion comprises a core and one or more components arranged along the core.

5. The cleaner head according to claim 4, wherein the core is a static core and the one or more components are configured to rotate around the core.

6. The cleaner head according to claim 4, wherein the core is configured to rotate and the one or more components are configured to rotate as the core rotates.

7. The cleaner head according to claim 1, further comprising a first set of bristles formed on the first elongate portion and a second set of bristles formed on the first curved portion.

8. The cleaner head according to claim 7, wherein the second set of bristles are more deformable than the first set of bristles.

9. The cleaner head according to claim 1, further comprising an energy storage device for providing energy to the drive assembly located in the first elongate portion.

10. The cleaner head according to claim 1, wherein the first curved portion and the at least one of the first elongate portion and the second elongate portion is configured to rotate in a direction to direct debris toward the suction region.

11. The cleaner head according to claim 1, further comprising a second curved portion located between a second end of the first elongate portion and a respective second end of the second elongate portion.

12. The cleaner head according to claim 11, wherein the brushbar arrangement completely surrounds the suction region.

13. The cleaner head according to claim 11, wherein the second curved portion, the first elongate portion and the second elongate portion are configured to rotate in an inward direction so as to direct debris toward the suction region.

14. The cleaner head according to claim 1, wherein the drive assembly comprises a belt and/or gearbox assembly for driving the second elongate portion.

15. The cleaner head according to claim 1, wherein the drive assembly comprises a second motor located in the second elongate portion.

16. The cleaner head of claim 1, wherein the first elongate portion of the brushbar comprises a first axis of rotation and the first curved portion of the brushbar comprises a different, second axis of rotation, wherein the second axis of rotation is curved.

17. A vacuum cleaner comprising the cleaner head of claim 1.

18. A robotic vacuum cleaner comprising the cleaner head of claim 1.

* * * * *